US011021003B2

(12) United States Patent
Roussel, Jr. et al.

(10) Patent No.: US 11,021,003 B2
(45) Date of Patent: Jun. 1, 2021

(54) HANDWRITING ASSISTIVE DEVICE

(71) Applicant: University of Louisville Research Foundation, Inc., Louisville, KY (US)

(72) Inventors: Thomas J. Roussel, Jr., Louisville, KY (US); Saralyn Callahan, Alexandria, KY (US); Andrea Behrman, Louisville, KY (US); Danielle Stout, Clarksville, IN (US)

(73) Assignee: University of Louisville Research Foundation, Inc., Louisville, KY (US)

( * ) Notice: Subject to any disclaimer, the term of this patent is extended or adjusted under 35 U.S.C. 154(b) by 43 days.

(21) Appl. No.: 16/513,969

(22) Filed: Jul. 17, 2019

(65) Prior Publication Data

US 2020/0023669 A1 Jan. 23, 2020

Related U.S. Application Data

(60) Provisional application No. 62/700,509, filed on Jul. 19, 2018.

(51) Int. Cl.

| | |
|---|---|
| ***B43K 23/008*** | (2006.01) |
| ***B43K 23/004*** | (2006.01) |
| ***B43K 23/012*** | (2006.01) |
| ***B43L 23/00*** | (2006.01) |
| ***B43L 15/00*** | (2006.01) |

(52) U.S. Cl.

CPC ..... *B43K 23/008* (2013.01); *B43K 23/004* (2013.01); *B43L 15/00* (2013.01); *B43K 23/012* (2013.01)

(58) Field of Classification Search

CPC .... B43K 23/008; B43K 23/00; B43K 23/001; B43K 23/002; B43K 23/004; B43K 23/012; B43K 23/016; B43K 23/02; B43K 29/00; B43L 15/00

USPC ..... 401/6, 131, 48

See application file for complete search history.

(56) References Cited

U.S. PATENT DOCUMENTS

| | | | | |
|---|---|---|---|---|
| 2,236,194 | A * | 3/1941 | Lorber | B43K 23/004 401/88 |
| 5,056,945 | A * | 10/1991 | Klodt | B43K 23/008 401/6 |
| 7,794,163 | B2 * | 9/2010 | Bush, III | B43K 23/012 401/7 |
| 9,205,696 | B2 * | 12/2015 | Young | B43K 23/004 |
| 2014/0219702 | A1 | 8/2014 | Pincus et al. | |

(Continued)

*Primary Examiner* — David J Walczak

(74) *Attorney, Agent, or Firm* — W & C IP

(57) ABSTRACT

An assistive device to promote the development or recovery of writing and drawing capabilities of a user. The device includes an elongated body having an outer surface and an inner channel for insertion of a writing instrument; a first positioning part forming a loop extending from the outer surface of the elongated body through which a thumb of a user may be inserted; a second positioning part forming a loop extending from the outer surface of the elongated body through which an index finger of a user may be inserted; and a third positioning part forming a loop extending from the outer surface of the elongated body through which a middle finger of a user may be inserted, wherein the first, second, and third positioning parts are arranged such that a user's thumb, index finger, and middle finger form a tripod grasp about the elongated body.

15 Claims, 8 Drawing Sheets

(56) References Cited

U.S. PATENT DOCUMENTS

| | | | |
|---|---|---|---|
| 2016/0159138 | A1 | 6/2016 | Vleisides et al. |
| 2016/0229219 | A1 | 8/2016 | Pincus |

* cited by examiner

HANDWRITING ASSISTIVE DEVICE

FIELD OF THE INVENTION

Embodiments of the invention provide an assistive device that promotes development or recovery of writing and drawing capabilities by orienting the fingers in a correct tripod grasp.

BACKGROUND OF THE INVENTION

Some individuals, due to age, injury, or disability, lack the strength and/or dexterity required to grip a writing instrument, such as a pen or pencil, such that they have great difficulty in writing independently. For example, pediatric spinal cord injury (SCI) patients often have upper extremity deficiencies that hinder formation of a correct tripod grasp. A variety of devices have been developed to help a child improve his or her grip; however, these devices have various shortcomings and generally fail to comfortably and conveniently promote proper grip positioning techniques. Further, such devices have been frustrating to use in that the user requires assistance to secure the device to the user's hand, and in that the device may be difficult to adjust to different writing instruments and to different user demands. Thus, new assistive writing devices that overcome the foregoing shortcomings are needed.

SUMMARY OF THE INVENTION

An assistive device, according to embodiments of the disclosure, comprises an elongated body having an outer surface and an inner channel for insertion of a writing instrument; a first positioning part forming a loop extending from the outer surface of the elongated body through which a thumb of a user may be inserted; a second positioning part forming a loop extending from the outer surface of the elongated body through which an index finger of a user may be inserted; and a third positioning part forming a loop extending from the outer surface of the elongated body through which a middle finger of a user may be inserted, wherein the first, second, and third positioning parts are arranged such that a user's thumb, index finger, and middle finger form a tripod grasp about the elongated body.

In some embodiments, a material lining the inner channel is deformable. In some embodiments, a diameter of the channel decreases along a length of the elongated body. In some embodiments, the elongated body has a length of at least 30 mm. In some embodiments, the outer surface of the elongated body has a triangular shape with three flat portions joined by rounded points. e.g. a fillet. In some embodiments, the first, second, and third positioning parts each project above a different flat portion of the outer surface of the elongated body. In some embodiments, the loop of one or more of the positioning parts is formed from two overlapping structures that may be separated to allow insertion or removal of a user's finger through an opening in the loop. In some embodiments, the loop of the third positioning part is formed from a single structure connected at each end to the elongated body. In some embodiments, an angle of the loop of one or more of the first, second, and third positioning parts is adjustable. In some embodiments, one or more of the first, second, and third positioning parts are removable from the elongated body. In some embodiments, the device further comprises a writing instrument inserted into the elongated body.

Other aspects of the disclosure provide a method of using an assistive device, comprising inserting a writing instrument into the assistive device, wherein the assistive device comprises an elongated body having an outer surface and an inner channel for insertion of the writing instrument; a first positioning part forming a loop extending from the outer surface of the elongated body through which a thumb of a user may be inserted; a second positioning part forming a loop extending from the outer surface of the elongated body through which an index finger of a user may be inserted; and a third positioning part forming a loop extending from the outer surface of the elongated body through which a middle finger of a user may be inserted, wherein the first, second, and third positioning parts are arranged such that a user's thumb, index finger, and middle finger form a tripod grasp about the elongated body; and inserting a thumb, index finger, and middle finger of a user into the first, second, and third positioning parts, respectively.

In some embodiments, one or more of the user's thumb, index finger, and middle finger are inserted through an opening in the loop of the corresponding positioning part formed from two overlapping structures that may be separated.

Additional features and advantages of the invention will be set forth in the description below, and in part will be apparent from the description, or may be learned by practice of the invention. The advantages of the invention can be realized and attained by the exemplary structure particularly pointed out in the written description and claims hereof as well as the appended drawings.

DETAILED DESCRIPTION

Figure 1A:
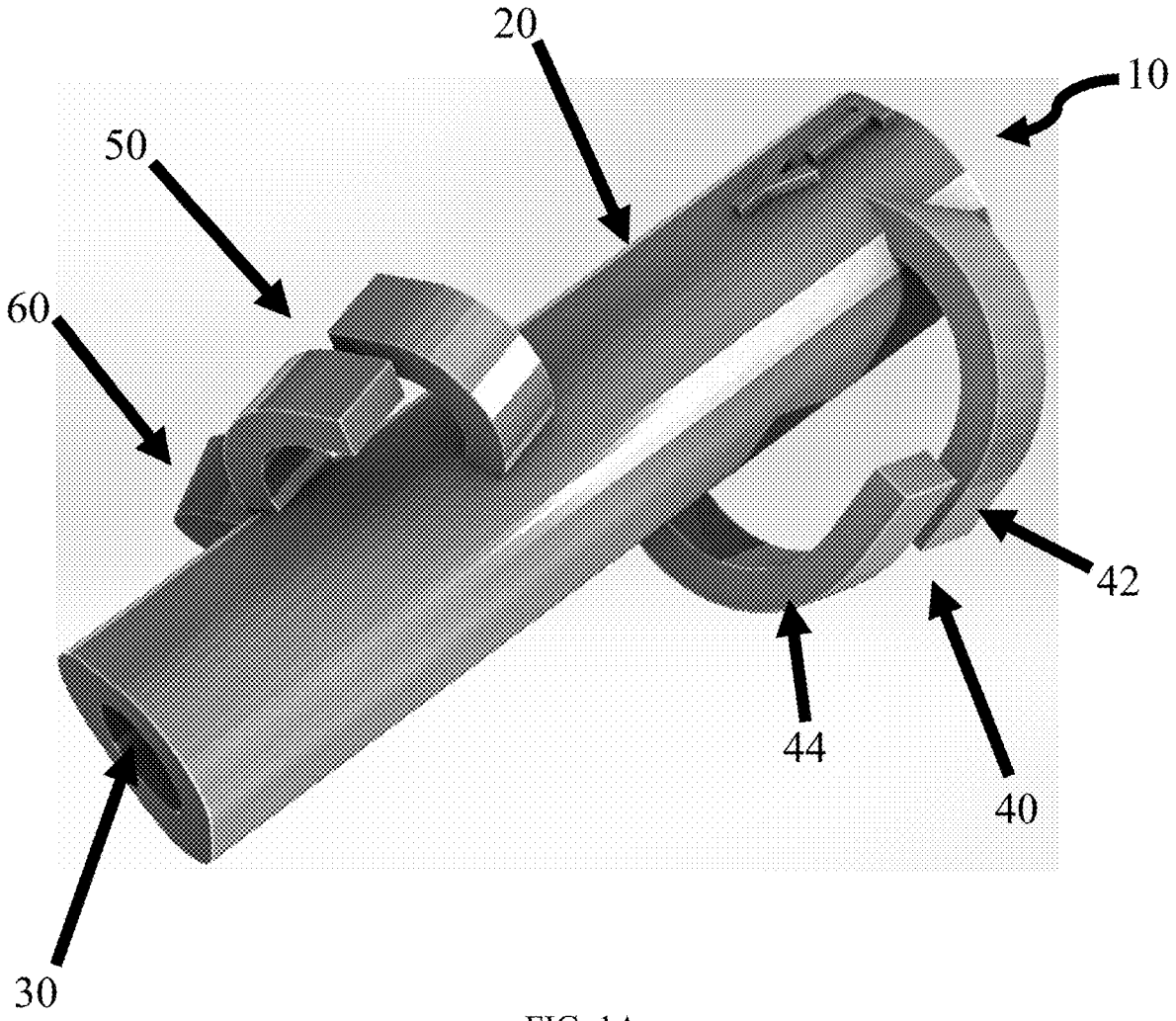
FIG. 1A. Isometric view of an assistive device according to some embodiments of the disclosure.
Figure 1B:
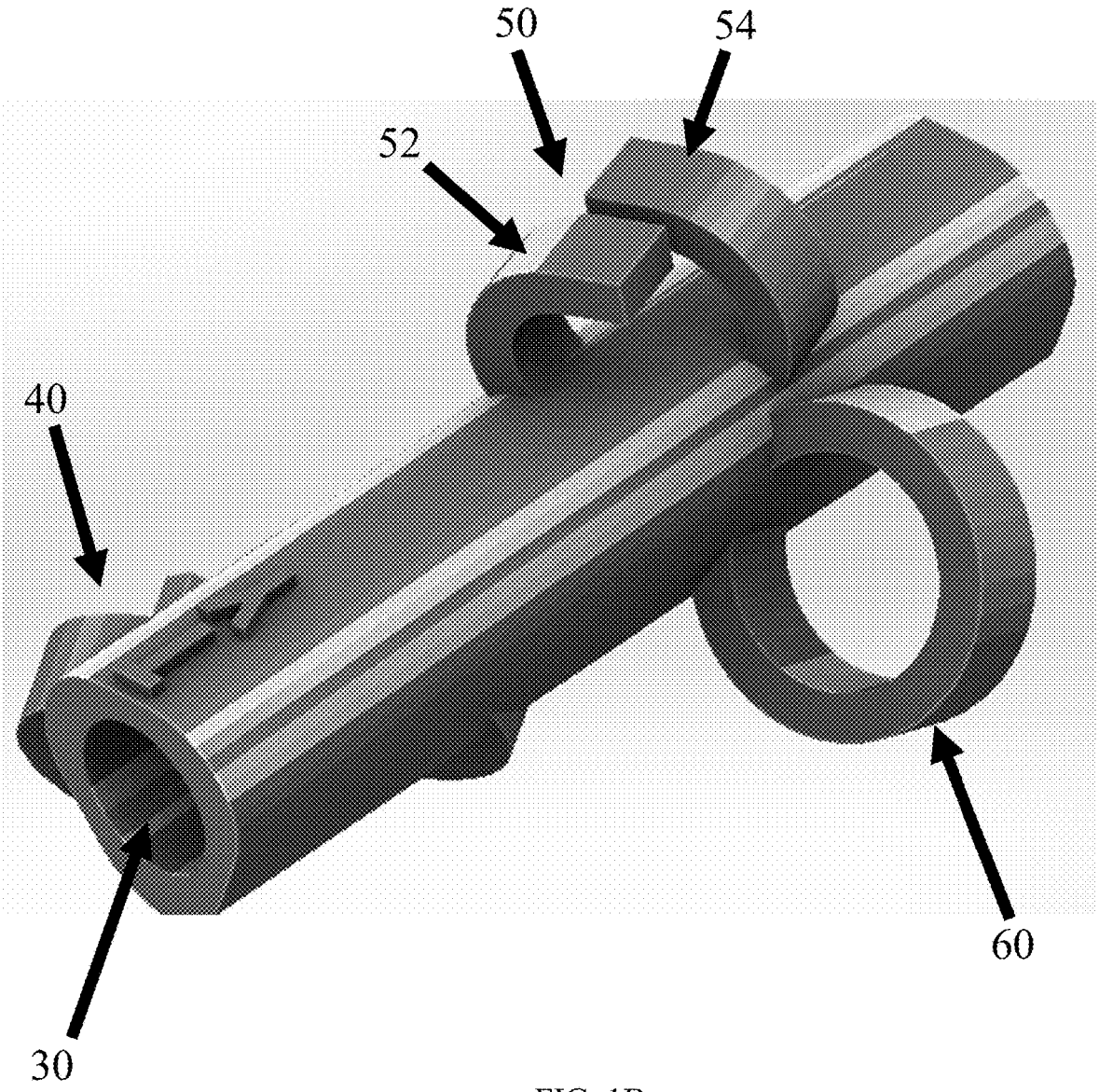
FIG. 1B. Alternative isometric view of an assistive device according to some embodiments of the disclosure.

Embodiments of the invention provide an assistive device that guides a user's fingers into the proper positioning about a writing instrument. The term "fingers" is used to refer to the digits on the hand, including the thumb. FIGS. 1A-E illustrate an exemplary embodiment of the assistive device. In FIGS. 1A and 1B, the assistive device 10 comprises an elongated body 20 having an outer surface and an inner channel 30 for insertion of a writing instrument; a first positioning part 40 forming a loop extending from the outer surface of the elongated body 20 through which a thumb of a user may be inserted; a second positioning part 50 forming a loop extending from the outer surface of the elongated body 20 through which an index finger of a user may be inserted; and a third positioning part 60 forming a loop extending from the outer surface of the elongated body through which a middle finger of a user may be inserted. The first, second, and third positioning parts are arranged such that a user's thumb, index finger, and middle finger form a tripod grasp about the elongated body.

Figure 2A:
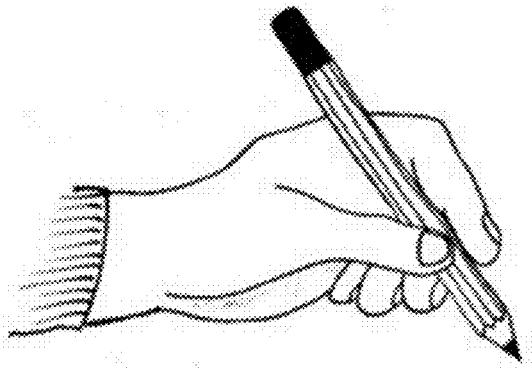
FIG. 2A. Exemplary illustration of a left-handed tripod grasp of a writing instrument.
Figure 2B:
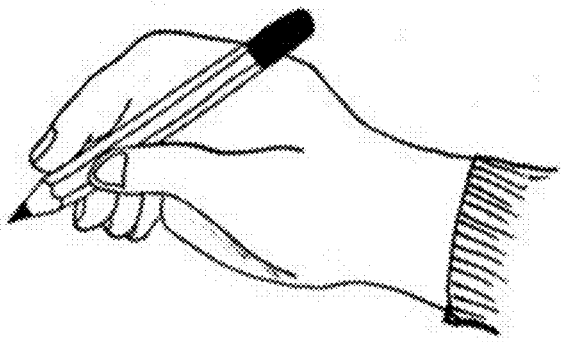
FIG. 2B. Exemplary illustration of a right-handed tripod grasp of a writing instrument.

With reference to FIGS. 2A-B, a tripod grip or grasp is a three-finger grasp and includes the index finger and thumb, with the writing utensil resting on the middle finger. The rest of the fingers are tucked into the palm. Movement of the writing instrument comes from the fingers with the support of the wrist and forearm.

Exemplary writing instruments compatible with a device of the disclosure include, but are not limited to, a pen (e.g. a ball-point pen, fountain pen, gel pen, rollerball pen, dip pen, brush pen, etc.), a pencil (e.g. a mechanical pencil, graphite pencil, charcoal pencil, wax pencil, etc.), a marker, a stylus (e.g. for touch screen electronic devices), chalk, a crayon, a paintbrush, etc.

Figure 1C:
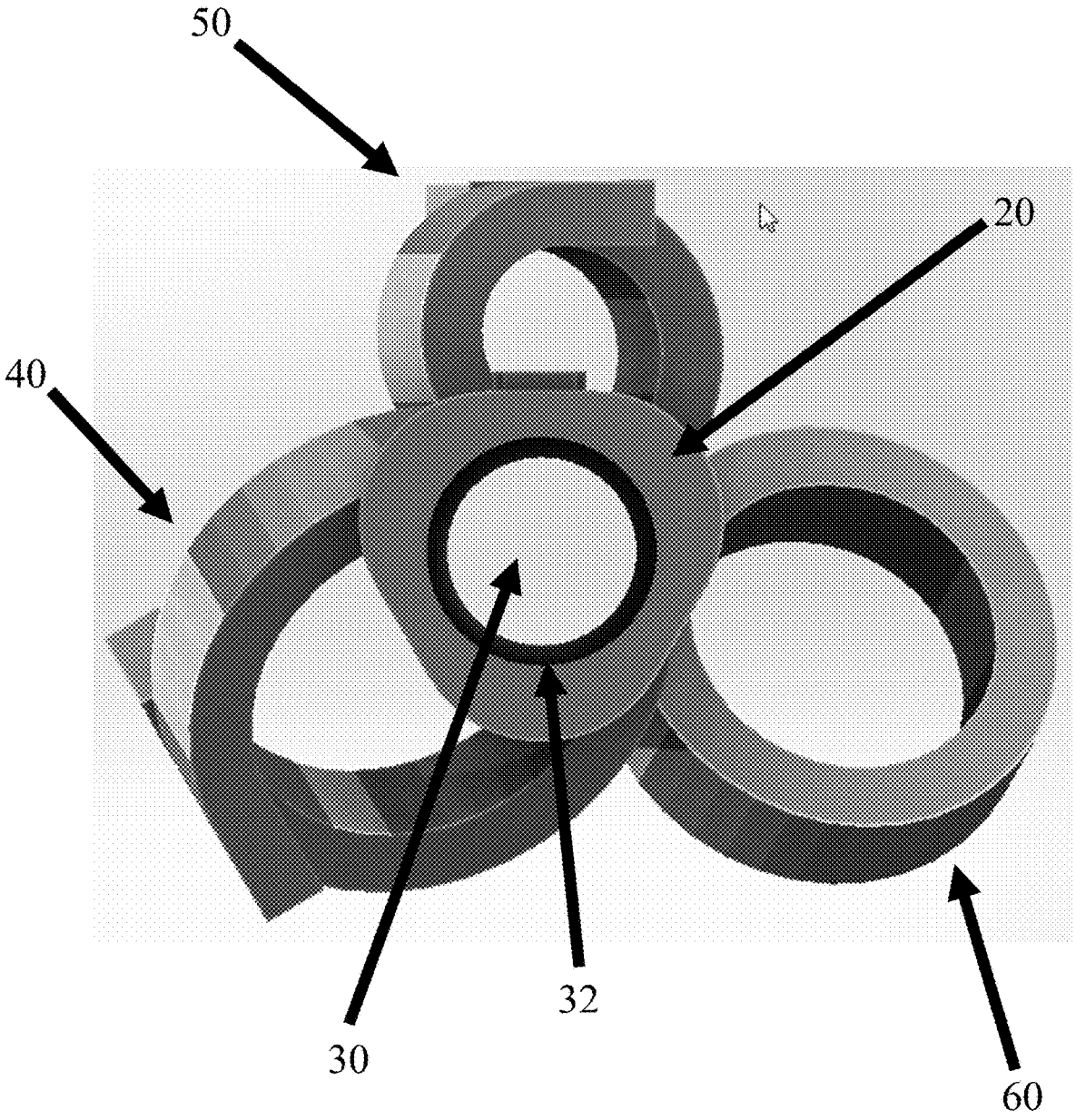
FIG. 1C. Cross section view from a top down perspective of an assistive device according to some embodiments of the disclosure.

With reference to FIG. 1C, a material 32 lining the channel 30 may be deformable or stretchable to accommodate various sizes and/or shapes of writing instruments (e.g. from narrow pens to thick markers). When the writing instrument is removed, the material can return to its original shape. For example, the material 32 may be rubber, silicone, thermoplastic polyurethane, etc. In some embodiments, the diameter of the channel 30 when an instrument is not inserted is in the range of 1-30 mm, e.g. 5-20 mm or 7-10 mm. In some embodiments, the diameter of the channel decreases along a length of the elongated body. For example, the diameter at one end of the device may be about 9 mm and may decrease to about 7.2 mm at the other end. The tapering of the channel allows for a more secure fit of many writing instruments that are narrower near the stylus portion of the instrument. The secure fit may ensure that the device does not slide out when the writing instrument is pushed across a surface, e.g. paper. In accordance with the shape of many writing instruments, in some embodiments, the channel diameter may be constant for most of the length of the device and begins to decrease near the stylus end of the device (the end closest to positioning parts 50 and 60 and opposite the end closest to positioning part 40). In some embodiments, the diameter is decreased only within one half the length or less of the channel 30.

In some embodiments, the assistive device does not cause "drag" when writing. Drag occurs when the instrument slips when writing, resulting in a wrong orientation of the writing instrument and increased difficulty to write continuously. By extending the length of the shaft of the device, drag is decreased and the instrument is maintained in the proper orientation. In some embodiments, the elongated body has a length of at least 30 mm, e.g. at least 35, 40, 45, 50, 55, or 60 mm or more.

In some embodiments, the outer surface of the elongated body 20 has a triangular shape with three flat portions joined by rounded points (FIG. 1C). The first, second, and third positioning parts (40, 50, 60) may each project above a different flat portion of the outer surface of the elongated body 20. The positioning parts may have a substantially circular or oval shape to accommodate the insertion of a user's fingers. Other shapes may also be used. The positioning parts are angled with respect to the elongated body such that the user's fingers are placed in a traditional tripod grasp. The positioning parts may be arranged at any angle from 0-90° with respect to the elongated body. For example, in some embodiments, the first positioning part 40 may have an angle 30-60°, 40-50°, or 45° from vertical. In some embodiments, the second positioning part 50 may have an angle 10-30°, 15-25°, or 18° from horizontal. In some embodiments, the third positioning part 60 may have an angle 50-70°, 55-65°, or at 60° from vertical.

The positioning parts may be placed at any point along the elongated body in order to orient the user's fingers into a tripod grasp. In some embodiments, the first positioning part 40 may be centered about 1-10 mm from a first end of the elongated body 20. In some embodiments, the second positioning part 50 may be centered about 15-25 mm (e.g. about 21 mm) from a second end of the elongated body 20. In some embodiments, the third positioning part 60 may be centered about 15-25 mm (e.g. about 19.5 mm) from the second end of the elongated body 20.

The openings defined by the positioning parts may be small enough in diameter to hold the fingers in the correct position, but large enough in diameter to allow the fingers to grip the shaft of the device on their own which is important when promoting recovery of handwriting skills. In some embodiments, the cross-sectional areas of the loop openings may be expandable and collapsible. The first positioning part 40 and the second positioning part 50 may have a diameter of about 5-15 mm, e.g. about 8.4 mm. The third positioning part 60 may have a diameter of about 5-25 mm, e.g. about 6-18 mm, e.g. about 12 mm.

Figure 1D:
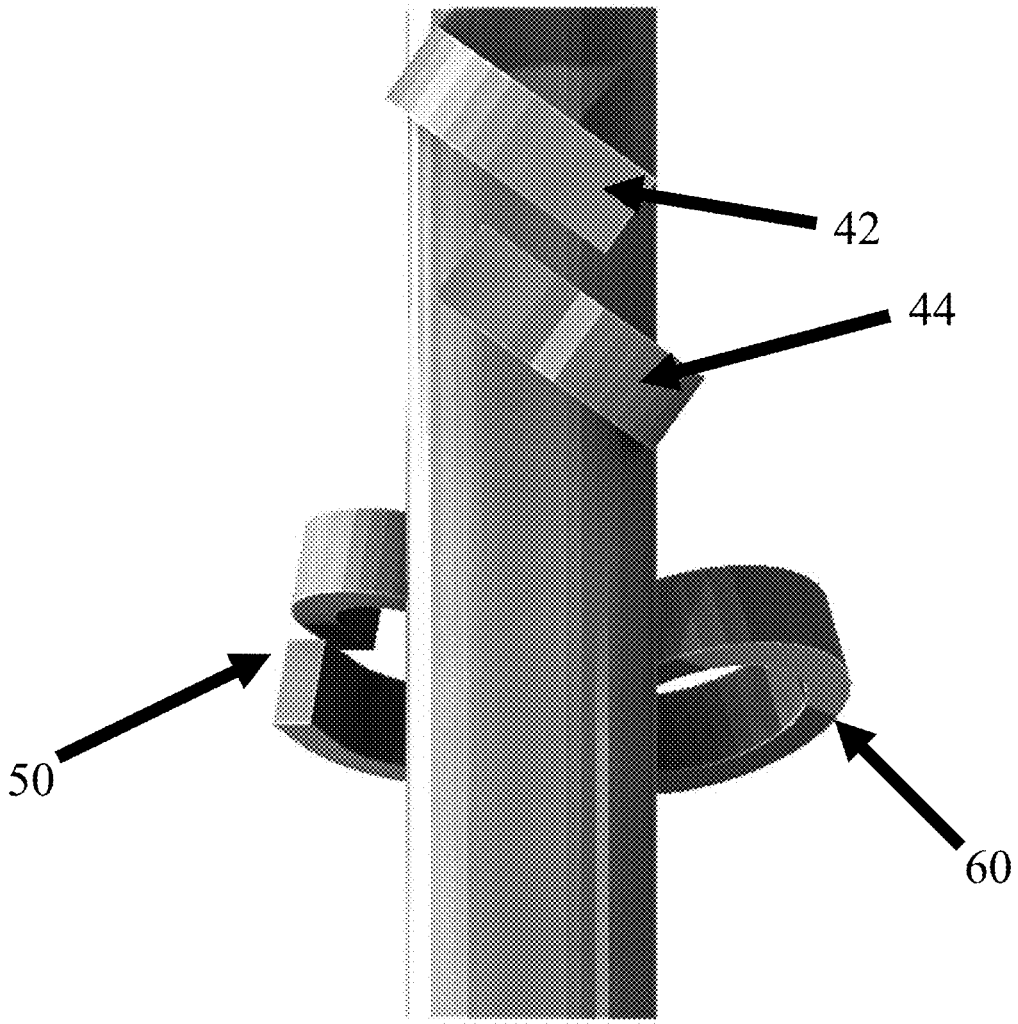
FIG. 1D. Top view of an assistive device according to some embodiments of the disclosure.
Figure 1E:
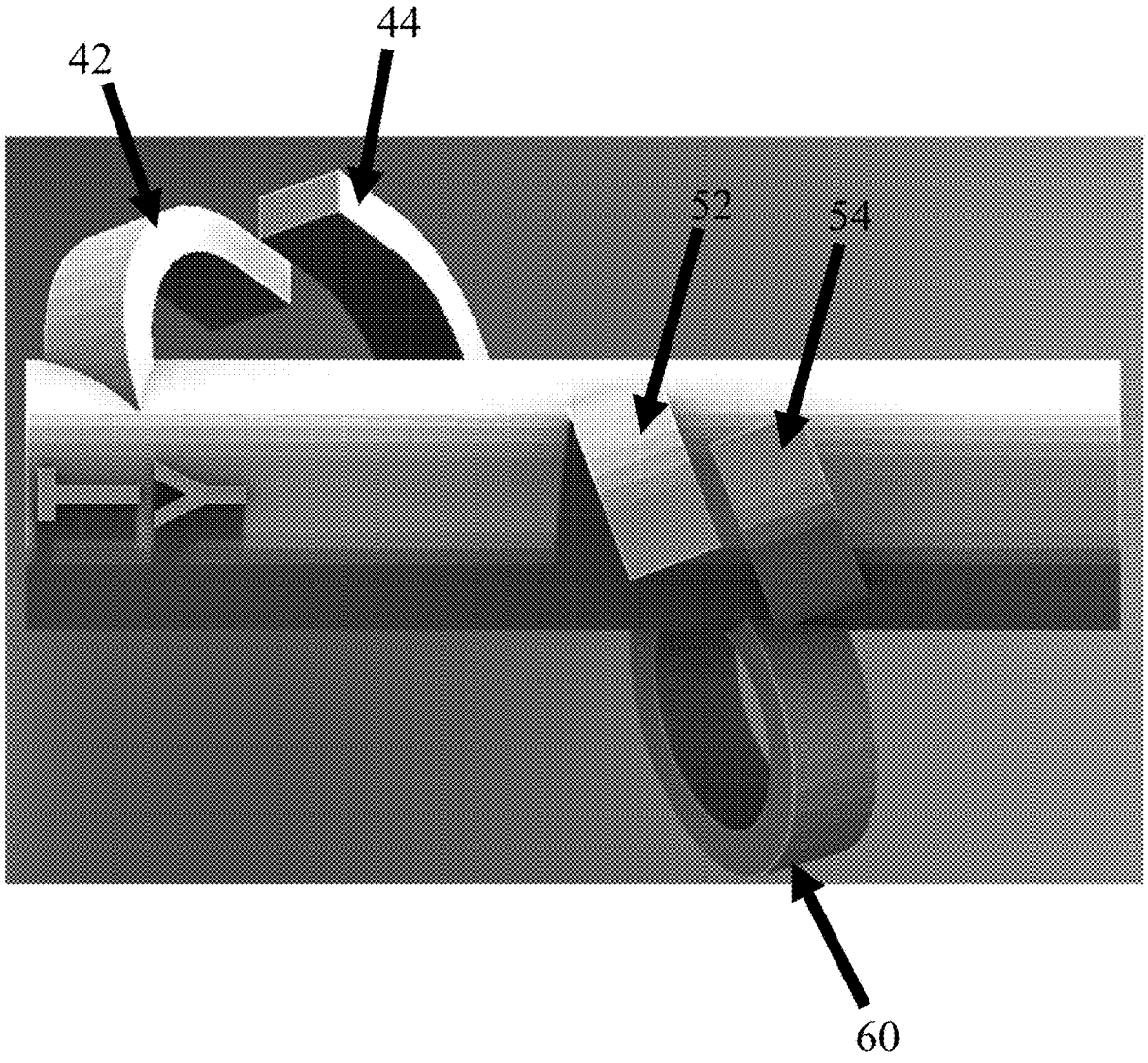
FIG. 1E. Side view of an assistive device according to some embodiments of the disclosure.

With reference to FIGS. 1D and 1E, the loop of the positioning parts may be formed from two overlapping structures (e.g. 42 and 44 form positioning part 40 or 52 and 54 form positioning part 50) that may be separated to allow insertion or removal of a user's finger through an opening or gap in the top of each loop. This feature is beneficial for users such as SCI patients that may not be able to bend their fingers independently and allows for them to slide their finger through the gap when putting on or taking off the device. In some embodiments, the first and second positioning parts (40, 50) are each formed from overlapping structures. In some embodiments, at least the loop of the third positioning part 60 is formed from a single structure connected at each end to the elongated body to accommodate the initial donning of the device.

The finger positioning components may be adjustable and/or removable depending on specific user needs or the recovery process. "Removable" means that detachment of the component does not cause physical damage to the components and/or the body of the device. For example, the components may be affixed to the body via a reusable adhesive, hook and loop fasteners, a mechanical fastener such as a screw, or any other appropriate fastening technique including a snap-fit connection or a slot-fit connection. Nerve distribution is different for the thumb and fingers; therefore, it is not uncommon for SCI patients to regain function of the thumb before regaining function of the fingers. As the patient recovers, the device can be adapted to be equipped with only the finger positioning components needed. In addition, even though the tripod grasp is the ideal handwriting technique, the exact angles for finger positioning may vary from person to person. Being able to adjust the angle of the finger positioning components to accommodate the user is advantageous since hand and finger size can vary from person to person.

In some embodiments, one or more of the finger positioning components are inseparable from the device and/or are not adjustable (i.e. detachment causes physical damage to the components and/or body of the device).

The device disclosed herein may be used by children or adults. Accordingly, the device may be configured in different sizes (e.g. small, medium, large) to accommodate different hand and finger sizes. In some embodiments, the device is custom designed for a particular user. The assistive device places the user's fingers in the proper tripod grasp. This is advantageous because it allows the user to write normally and promotes a proper writing technique. In some embodiments, the device may be used by pediatric spinal cord injury patients with limited hand movement. In these patients, the device can be used for activity-dependent rehabilitation since the device does not provide compensation. The aim of this form of rehabilitation is to promote and advance pre-injury movement patterns to achieve the task. Thus "how" the task is completed is valued over the simple achievement of the task. The device may also be used by individuals having normal hand functioning to further develop and promote proper writing/drawing capabilities through orienting the fingers in a tripod grasp.

While FIGS. 1A-E illustrate a device for a right-handed user, the device may also be configured for left-handed users. In some embodiments, the device may be personalized, e.g. to include a user's name or initials on the surface of the device.

In some embodiments, the device allows for independent use. A user with limited/hindered hand capacity can independently put on and take off the device which eliminates the previous need of a caregiver, teacher, or peer to assist the user.

The device may be made from any material. While different sections may be made from the same materials, such is not a requirement. The device may be made from materials such as but not limited to: metals such as gold, silver, platinum, titanium, and alloy, glass or fiberglass, rubber, silicone, composite materials, and plastic such as, but not limited to, thermoplastic polyurethane (TPU), polyethylene terephthalate (PET), high-density polyethylene, polyvinyl chloride (PVC), polyvinylidene chloride (PVDC), polystyrene (PS), high impact polystyrene (HIPS) and polycarbonate (PC), or some combination thereof. It is preferred that the material is robust and durable.

The device disclosed herein may be fabricated by any suitable technique known in the art as a one piece body or multiple pieces joined together. In some embodiments, additive technology such as 3D printing is used with a material such as thermoplastic polyurethane (TPU) filament. Other techniques such as injection molding with materials such as silicone may be used. The use of a semi-flexible material having high strength and high flexibility is advantageous. This combination allows for the device to be stretched and bend when a force is applied, but returns to the original shape when the load is removed. The flexibility of the material also decreases the chance of "pinching" of the skin or roughness that may be harmful. This is significant with SCI users or other users that have limited nerve function in their hands because they do not experience the same sensation of pain as that of a person with normal nerve function.

Some aspects of the disclosure provide a device as disclosed herein pre-packaged with a writing instrument inserted into the elongated body. The connection between the writing instrument and the device may be removable (i.e. detachment does not cause physical damage to the components) or permanent (i.e. detachment causes physical damage to the components).

Figure 3A:
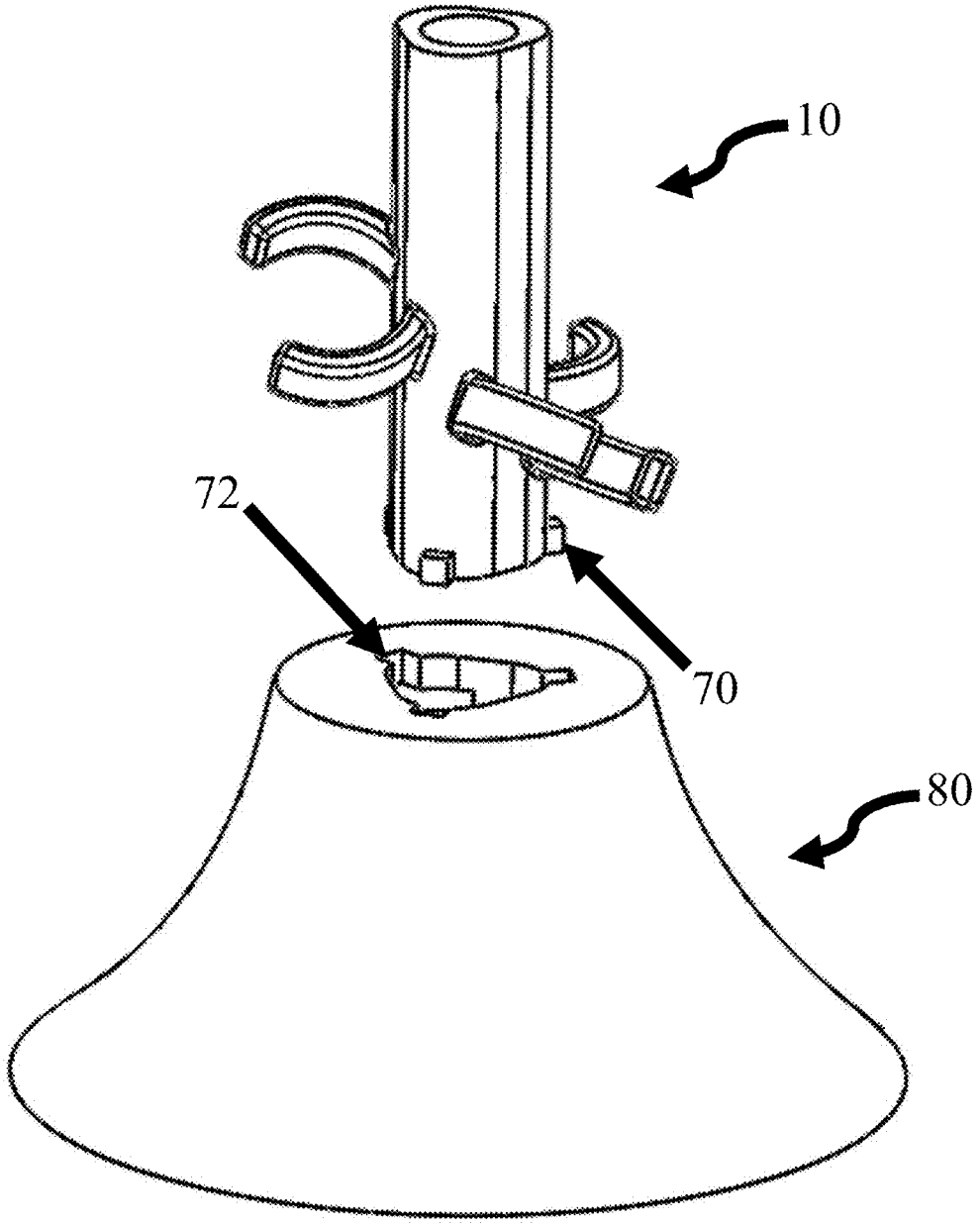
FIGS. 3A-B. Exemplary illustration of an assistive device and an interlocking fixture either (A) separated or (B) joined according to some embodiments of the disclosure.
Figure 3B:
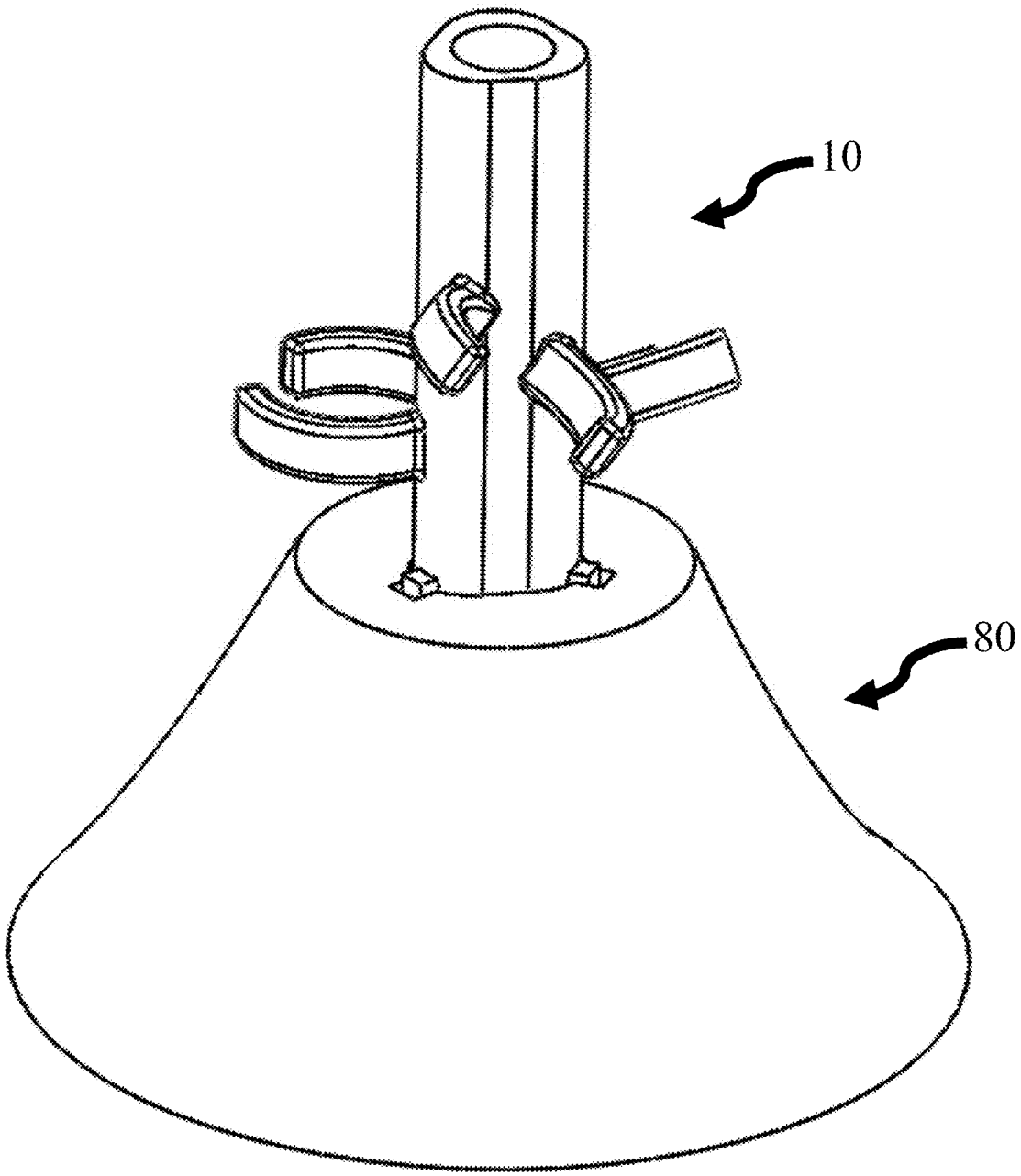

In some embodiments, an interlocking fixture 80 may be paired with the assistive device to promote independent use for users with extreme limited hand capacity (FIG. 3A-B). The front end of the assistive device may be equipped with a male component 70, i.e. one or more protrusions such as a three square-shaped table, that fits into a fitted female socket 72 of the fixture 80. Once inserted into the socket 72, the assistive device can be rotated to lock into place. In some embodiments, the assistive device contains a female component and the interlocking fixture contains a male component. The fixture 80 may be made of the same or a different material as the assistive device. In some embodiments, the fixture 80 is weighted, e.g. filled with sand, water, etc. to stabilize the fixture on a surface. In some embodiments, the fixture 80 is removably or permanently attached to a surface. By using the interlocking fixture 80, the assistive device is in a ready-to-use position that is stabilized while the user independently puts on or takes off the device. This feature is advantageous for patients with upper extremity deficiencies since they could most likely not stabilize the device in their non-dominant hand, while attempting to put on or take off the device from their dominant hand. As patients recover, the need for use of the interlocking fixture may no longer exist and the fixture can be easily removed from the putting on and taking off process.

Other aspects of the disclosure provide a method for using a device as described herein. Such methods may comprise the steps of inserting a writing instrument into the assistive device and inserting a thumb, index finger, and middle finger of a user into the first, second, and third positioning parts, respectively. In some embodiments, one or more of the user's thumb, index finger, and middle finger are inserted through an opening in the loop of the corresponding positioning part formed from two overlapping structures that may be separated.

It is to be understood that this invention is not limited to particular embodiments described, as such may, of course, vary. It is also to be understood that the terminology used herein is for the purpose of describing particular embodiments only, and is not intended to be limiting, since the scope of the present invention will be limited only by the appended claims.

Where a range of values is provided, it is understood that each intervening value, to the tenth of the unit of the lower limit unless the context clearly dictates otherwise, between the upper and lower limit of that range and any other stated or intervening value in that stated range, is encompassed within the invention. The upper and lower limits of these smaller ranges may independently be included in the smaller ranges and are also encompassed within the invention, subject to any specifically excluded limit in the stated range. Where the stated range includes one or both of the limits, ranges excluding either or both of those included limits are also included in the invention.

It is noted that, as used herein and in the appended claims, the singular forms "a", "an", and "the" include plural referents unless the context clearly dictates otherwise. It is further noted that the claims may be drafted to exclude any optional element. As such, this statement is intended to serve as antecedent basis for use of such exclusive terminology as "solely," "only" and the like in connection with the recitation of claim elements, or use of a "negative" limitation.

As will be apparent to those of skill in the art upon reading this disclosure, each of the individual embodiments described and illustrated herein has discrete components and features which may be readily separated from or combined with the features of any of the other several embodiments without departing from the scope or spirit of the present invention. Any recited method can be carried out in the order of events recited or in any other order which is logically possible.

While the invention has been described in terms of its preferred embodiments, those skilled in the art will recognize that the invention can be practiced with modification within the spirit and scope of the appended claims. Accordingly, the present invention should not be limited to the embodiments as described above, but should further include all modifications and equivalents thereof within the spirit and scope of the description provided herein.

We claim:

1. An assistive device, comprising:

an elongated body having an outer surface and an inner channel for insertion of a writing instrument;

a first positioning part forming a loop extending from the outer surface of the elongated body through which a thumb of a user may be inserted;

a second positioning part forming a loop extending from the outer surface of the elongated body through which an index finger of a user may be inserted; and a third positioning part forming a loop extending from the outer surface of the elongated body through which a middle finger of a user may be inserted, wherein the first, second, and third positioning parts are arranged such that a user's thumb, index finger, and middle finger form a tripod grasp about the elongated body, wherein the loop of one or more of the positioning parts is formed from two overlapping structures that may be moved apart to allow insertion or removal of a user's finger through a side opening in the loop and wherein the overlapping portion of each overlapping structure is not connected to the overlapping portion of the other overlapping structure.

2. The assistive device of claim 1, wherein a material lining the channel is deformable.

3. The assistive device of claim 1, wherein a diameter of the channel decreases along a length of the elongated body such that the channel diameter at a first end of the elongated body is less than the channel diameter at a second end of the elongated body.

4. The assistive device of claim 1, wherein the elongated body has a length of at least 30 mm.

5. The assistive device of claim 1, wherein the outer surface of the elongated body has a triangular shape with three flat portions joined by rounded points.

6. The assistive device of claim 5, wherein the first, second, and third positioning parts each project above a different flat portion of the outer surface of the elongated body.

7. The assistive device of claim 1, wherein the loop of the third positioning part is formed from a single structure connected at each end to the elongated body.

8. The assistive device of claim 1, wherein an angle of the loop of one or more of the first, second, and third positioning parts is adjustable.

9. The assistive device of claim 1, wherein one or more of the first, second, and third positioning parts are removable from the elongated body.

10. The assistive device of claim 1, further comprising one or more protrusions extending from the outer surface at an end of the elongated body, wherein the one or more protrusions are configured to attach in an interlocking manner to a fixture.

11. The assistive device of claim 1, further comprising a writing instrument inserted into the elongated body.

12. The assistive device of claim 1, wherein only the loops of the first and second positioning parts are formed from two overlapping structures.

13. A method of using an assistive device, comprising:

inserting a writing instrument into the assistive device, wherein the assistive device comprises an elongated body having an outer surface and an inner channel for insertion of the writing instrument;

a first positioning part forming a loop extending from the outer surface of the elongated body through which a thumb of a user may be inserted;

a second positioning part forming a loop extending from the outer surface of the elongated body through which an index finger of a user may be inserted; and a third positioning part forming a loop extending from the outer surface of the elongated body through which a middle finger of a user may be inserted, wherein the first, second, and third positioning parts are arranged such that a user's thumb, index finger, and middle finger form a tripod grasp about the elongated body, wherein the loop of one or more of the positioning parts is formed from two overlapping structures that may be moved apart to allow insertion or removal of a user's finger through a side opening in the loop and wherein the overlapping portion of each overlapping structure is not connected to the overlapping portion of the other overlapping structure; and inserting a thumb, index finger, and middle finger of a user into the first, second, and third positioning parts, respectively.

14. The method of claim 13, wherein one or more of the user's thumb, index finger, and middle finger are inserted through an opening in the loop of the corresponding positioning part formed from two overlapping structures that may be separated.

15. The method of claim 13, wherein only the loops of the first and second positioning parts are formed from two overlapping structures.

* * * * *